United States Patent [19]

Stokes

[11] Patent Number: 4,570,607

[45] Date of Patent: Feb. 18, 1986

[54] TENNIS BALL THROWING MACHINE WITH CONTINUOUSLY ROTATABLE BARREL HAVING FRICTION STRIP ON ONE SIDE ONLY OF INNER WALL

[76] Inventor: Gilbert A. Stokes, Star Rte., Mountain Ranch, Calif. 95246

[21] Appl. No.: 524,434

[22] Filed: Aug. 18, 1983

[51] Int. Cl.[4] ..... F41F 1/04

[52] U.S. Cl. ..... 124/56; 124/81

[58] Field of Search ..... 124/56, 59, 81, 83, 124/78; 273/63 A, DIG. 30, 26 D, 29 A, 30

[56] References Cited

U.S. PATENT DOCUMENTS

| | | | |
|---|---|---|---|
| 1,478,597 | 12/1923 | Bebler | 124/59 |
| 2,182,369 | 12/1939 | Barron | 124/81 |
| 3,640,263 | 2/1972 | Rhodes | 124/81 X |
| 3,662,729 | 5/1972 | Henderson | 124/81 X |
| 3,838,676 | 10/1974 | Kahelin | 124/81 X |
| 3,847,132 | 11/1974 | Schatz | 124/81 X |
| 3,905,349 | 9/1975 | Nielsen et al. | 124/56 X |
| 4,006,726 | 2/1977 | Sweeton et al. | 124/81 |
| 4,021,037 | 5/1977 | Torbet | 124/56 X |
| 4,077,386 | 3/1978 | Berliner | 124/78 |
| 4,086,903 | 5/1978 | Scott | 124/78 |
| 4,091,791 | 5/1978 | Castelli et al. | 124/81 X |
| 4,108,432 | 8/1978 | Clark et al. | 273/29 A |
| 4,168,695 | 9/1979 | Haller et al. | 124/16 |
| 4,207,857 | 6/1980 | Balka, Jr. | 124/56 |
| 4,241,717 | 12/1980 | Mariani | 124/56 X |
| 4,250,862 | 2/1981 | Speer | 124/56 |
| 4,270,511 | 6/1981 | Ehama | 124/56 X |
| 4,291,665 | 9/1981 | Bash et al. | 124/56 |
| 4,299,383 | 11/1981 | Yuasa | 124/78 X |
| 4,325,351 | 4/1982 | Yuasa | 124/81 X |
| 4,345,578 | 8/1982 | Speer | 124/56 |
| 4,372,283 | 2/1983 | Balka, Jr. | 124/56 |

FOREIGN PATENT DOCUMENTS

| | | | |
|---|---|---|---|
| 777025 | 1/1968 | Canada | 273/63 A |

*Primary Examiner*—Richard T. Stouffer

*Attorney, Agent, or Firm*—Littlepage & Webner

[57] ABSTRACT

A tennis ball throwing machine pneumatically expels tennis balls through a barrel having on one side of its inner wall a Velcro strip for spinning the ball. The barrel is rotated about its lengthwise axis so that the sense of the spin, topspin, backspin, or right or left hand spin, varies in dependence upon the angular disposition of the Velcro strip as of the moment the ball passes it. The output end of the barrel is bent at an angle to its lengthwise axis resulting in an orbital motion.

6 Claims, 5 Drawing Figures

TENNIS BALL THROWING MACHINE WITH CONTINUOUSLY ROTATABLE BARREL HAVING FRICTION STRIP ON ONE SIDE ONLY OF INNER WALL

RELATED APPLICATION

Stokes: Ball Feeder for Throwing Machine filed concurrently herewith.

FIELD OF INVENTION

Mechanical Guns and Projectors, Fluid Pressure, means for producing projectile spin or deflection in Class 124, sub-classes 56 and 81.

PRIOR ART

Stokes U.S. Pat. No. 3,990,426 and Balka, Jr. U.S. Pat. No. 4,372,283.

BACKGROUND AND OBJECTS

This is an improvement over the machine of my prior patent, supra, wherein tennis balls are sequentially fed through a flexible, normally leaky flap valve into a plenum chamber and discharged therefrom through a barrel. Choking of the ball in the barrel raises the pressure in the plenum chamber and forces the flap sealingly against the chamber wall and thereby creates a sudden rise in air pressure behind the ball.

Throughout this art, various means have been devised for imitating the wiles of a top-flight server, for example, friction strips have been placed in the barrel for applying spin to the ball and crank and link mechanisms (see Balka, Jr., supra) have been used to oscillate a barrel about vertical and horizontal axes. By and large, these devices all suffer, in greater or lesser degree, from regularity such that the player to whom the ball is served can anticipate the variations in height or direction which the ball partakes. The object now is to provide a ball throwing machine having virtually infinite variations in throwing direction and ball spin, so that the player who is to return the ball never knows whether the ball will come at him high or low, to the right or left or with forespin, backspin, or bounce to his left or right.

Towards this end it is intended now to provide a tennis ball throwing machine wherein a barrel through which a ball is propelled not only has a spin-imparting Velcro strip on one side of its inner wall, but also has a mechanism for rotating the barrel about its lengthwise axis so that the type of spin (fore, back, etc.) varies cyclically and wherein the end of the barrel is bent so as to partake of an orbital motion as it is rotated.

These and other objects are apparent from the following specification and drawings in which.

Figure 1:
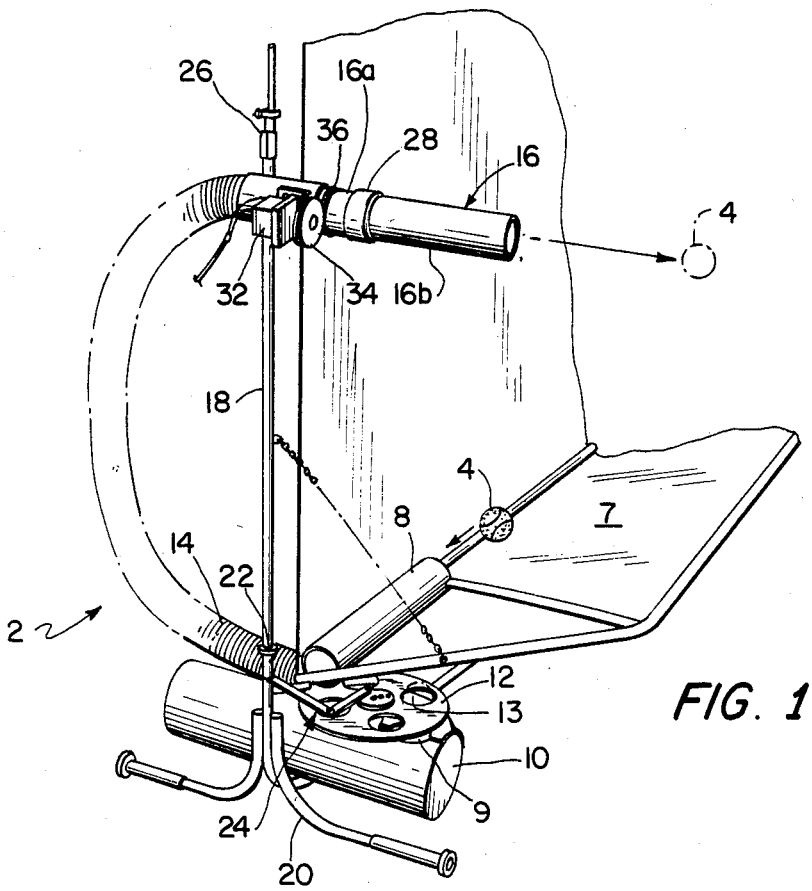
FIG. 1 is a perspective view of the entire machine in typical environment.

Referring now to the drawings, in which like reference numerals denote similar elements, the tennis ball throwing machine 2 pneumatically propels tennis balls 4. A player returns to a target 6 having an apron 7, the collected balls rolling to and through a downwardly inclined tubular chute 8 from which the balls are fed to a pneumatic dispatcher 10, preferably like the one shown in my prior U.S. Pat. No. 3,990,426 (supra). The collected tennis balls are transported from chute 8 to the entrance 9 of the pneumatic dispatcher by feed disk 12 having pockets 13 in which the balls are transported, one by one, to the entrance of the pneumatic dispatcher. From the pneumatic dispatcher 10 the tennis balls are propelled through a flexible hose 14 and expelled via a barrel 16 having separable inner and outer end portions **16*a* and 16*b*. The inner end portion 16*a* of barrel 16 is rotatably mounted in a sleeve 30 detailed hereinafter, the sleeve 30 being supported on a vertical post 18 which is rotatably mounted on a stand 20 by a rotary bearing 22. An oscillating mechanism 24, oscillates post 18 so as to swing barrel 16 to the left and right as indicated in full and broken lines in FIG. 2. Sleeve 30 is vertically adjustable on post 18 by clamp 26**.

Figure 5:
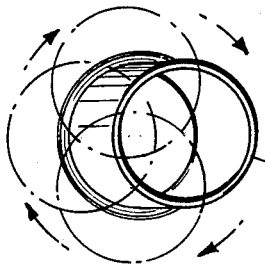
Figure 2:
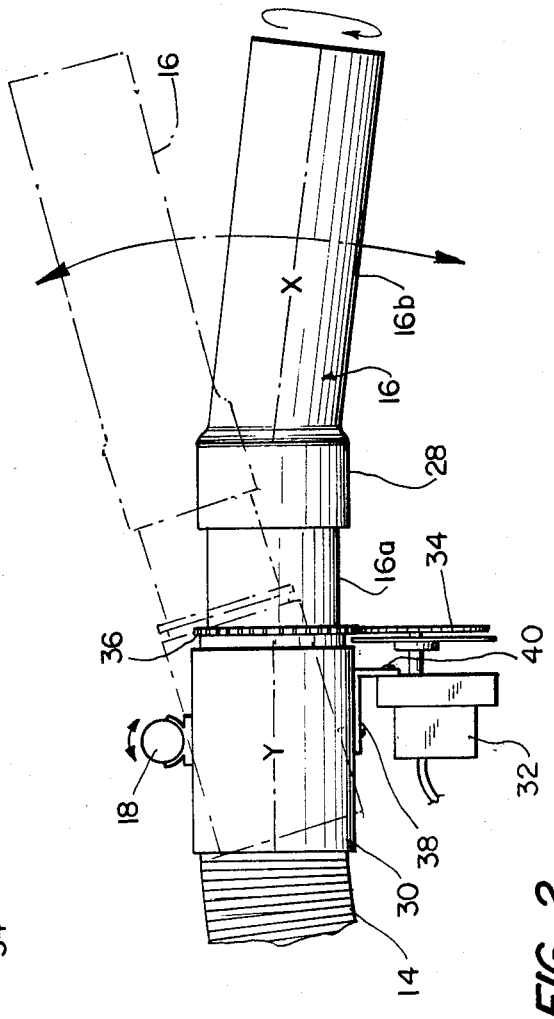
FIG. 2 is a plan view of the barrel rotating mechanism.

Referring particularly to FIG. 2 of the drawings, the outer end portion **16*b* of barrel 16 is joined to the iner end portion 16*a* by an offset coupling 28 so that the axis X of the outer end portion 16*b* of the barrel is disposed at an angle to the axis Y of the inner end portion 16*a*. As will be apparent from FIG. 5, this offset coupling 28 results in an orbital motion of the free end of barrel portion 16*b* when the barrel 16** is rotated.

Figure 3:
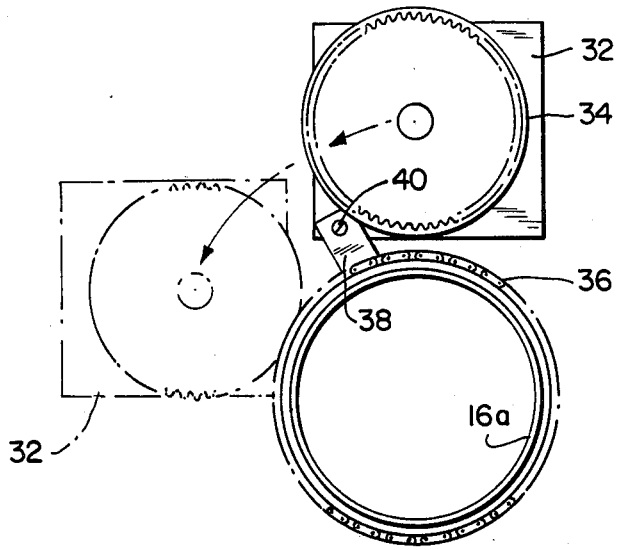
FIG. 3 is a fragmentary diagrammatic view illustrating the over-center pivotal motion of the motor and clutching-declutching action.

Barrel 16 is rotated by an electric motor 32 which has a driving pinion 34 drivingly engageable with a ring gear 36 around the inner end barrel portion **16*a*. Referring particularly to FIG. 3, a bracket 38 on sleeve 30 pivotally supports motor 32 by a pivotal connection 40 so that the motor and its pinion can swing between two over-center positions, in one of which pinion 34 drivingly engages ring gear 36 and in the other position the pinion 34 is disenged from ring gear 36**.

Figure 4:
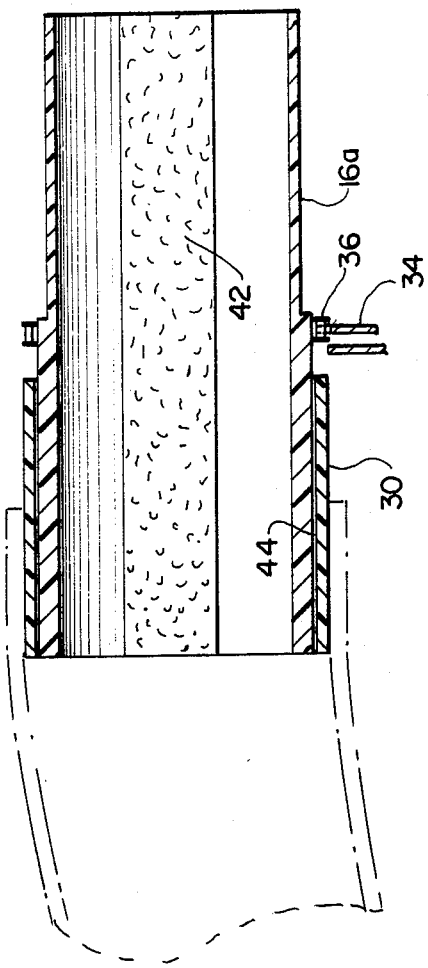
FIG. 4 is a fragmentary cross-section through the inner end portion of the barrel, rotary bearing mounting of the barrel and Velcro strip along one side of the inner side of the barrel; and, FIG. 5 is a diagram illustrating the orbital motion of the free end of the outer portion of the barrel.

As shown in FIG. 4, extending along one side of the inner wall of the inner end barrel portion **16*a* is a Velcro strip 42. Sleeve 30 provides a rotary bearing as indicated at 44 for the inner end barrel portion 16*a*, there being conventional thrust bearings (not shown) to prevent endwise dislodgement of the inner end portion 16*a* of the barrel from sleeve 30. A conventional coupling connects flexible hose 14 to sleeve 30**.

In operation, when the pneumatic dispatcher 10 is started and barrel rotating motor is energized, the barrel is rotated so that tennis balls 4 dispatched therethrough are given a spin, top, back, or one side or the other, depending upon the angular disposition of the Velcro strip in the inner end portion of the barrel. It should be understood that a straight barrel should be used so that only a varying spin effect is obtained. However, when a barrel having an angularly offset portion such as illustrated in FIG. 2 is used, then the free end of the barrel is given an orbital motion as diagrammically illustrated in FIG. 5 so as to vary the direction of propulsion of the ball; and if then the oscillating mechanism 24 is enabled, the entire barrel scans back and forth from side to side. The orbital position of the barrel may enhance or detract from the sidewise positioning of the barrel resulting from the oscillations imparted thereto, depending upon how they coincide with one another.

I claim:

1. A tennis ball throwing machine comprising a barrel, support means for supporting the barrel for rotation about its lengthwise axis, means for successively feeding tennis balls to the barrel, means for successively propelling said balls through the barrel, friction strip means on one side only of the inner wall of the barrel for imparting spin to a ball propelled therepast, and motor means connected to the barrel for continuously rotating the barrel through 360 degrees about the longitudinal axis of the barrel so as to continuously rotate the friction strip means around said longitudinal axis whereby to continuously vary the sense of the spin from top spin to back spin and side spin to side spin.

2. A tennis ball throwing machine as claimed in claim 1, said barrel having an input end portion and an output end portion connected thereto, the support means including bearing means for the inner end portion of the barrel, the lengthwise axis of the output end portion of the barrel being disposed at an angle to the lengthwise axis of the input end portion whereby the free end of the output end of the barrel undergoes orbital motion as the barrel is rotated.

3. A tennis ball throwing machine as claimed in claim 2, the length of said barrel being normally disposed generally horizontally, said support means including a vertically elongate post for supporting said barrel above the ground, means for supporting said post for rotation about its lengthwise axis, and motor means for oscillating said post about its rotational axis, whereby to swing said barrel from side-to-side while the free end of the output end of the barrel undergoes orbital motion and the Velcro strip imparts spin of various senses to the ball.

4. A tennis ball throwing machine as claimed in claim 1, the connection between the motor means and the barrel comprising a ring gear on the inner end portion of the barrel, a pinion rotatably driven by the motor means, and means for selectively engaging and disengaging the pinion with the ring gear.

5. A tennis ball throwing machine as claimed in claim 1, the length of said barrel being normally disposed generally horizontally, said support means including a vertically elongate post for supporting said barrel above the ground, means for supporting said post for rotation about its lengthwise axis, and motor means for oscillating said post about its rotational axis, whereby to swing said barrel from side-to-side.

6. A tennis ball throwing machine as claimed in claim 1, said friction strip means being Velcro.

* * * * *